US010116045B2

(12) United States Patent
Kaneko

(10) Patent No.: US 10,116,045 B2
(45) Date of Patent: Oct. 30, 2018

(54) ANTENNA DEVICE

(71) Applicant: HARADA INDUSTRY CO., LTD., Tokyo (JP)

(72) Inventor: Kiyokazu Kaneko, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 15/660,674

(22) Filed: Jul. 26, 2017

(65) Prior Publication Data

US 2018/0034139 A1 Feb. 1, 2018

(30) Foreign Application Priority Data

Jul. 28, 2016 (JP) ..... 2016-148556

(51) Int. Cl.

| | |
|---|---|
| ***H01Q 1/32*** | (2006.01) |
| ***H01Q 1/22*** | (2006.01) |
| ***H01Q 9/04*** | (2006.01) |
| *H01Q 9/30* | (2006.01) |

(52) U.S. Cl.

CPC ..... *H01Q 1/325* (2013.01); *H01Q 1/22* (2013.01); *H01Q 1/3208* (2013.01); *H01Q 9/0428* (2013.01); *H01Q 9/30* (2013.01)

(58) Field of Classification Search

CPC ..... H01Q 1/325; H01Q 1/22; H01Q 1/3208; H01Q 9/0428; H01Q 9/30; H05K 999/99

See application file for complete search history.

(56) References Cited

U.S. PATENT DOCUMENTS

| | | | |
|---|---|---|---|
| 6,614,405 | B1 | 9/2003 | Mikkonen et al. |
| 2008/0070513 | A1 | 3/2008 | Noro et al. |

FOREIGN PATENT DOCUMENTS

| | | | |
|---|---|---|---|
| JP | H02-66011 | U | 5/1990 |
| JP | H03-95542 | U | 9/1991 |
| JP | 2001-297561 | A | 10/2001 |
| JP | 2001-326477 | A | 11/2001 |
| JP | 2003-046324 | A | 2/2003 |
| JP | 2008078895 | A | 4/2008 |
| JP | 2010050886 | A | 3/2010 |

OTHER PUBLICATIONS

A Notice of Allowance in the corresponding Japanese Patent Application No. 2016-148556 dated Jun. 26, 2018.

*Primary Examiner* — Dameon E Levi
*Assistant Examiner* — David Lotter

(57) ABSTRACT

An antenna element comprises a plate with a first opening, the plate including a first main surface and a second main surface opposed to each other, and a case. The case comprises: a first projection projecting toward an inside of the case and passing through the first opening; a first head provided to a tip end of the first projection, the first head being in contact with the first main surface; and a first supporter in contact with the second main surface. A first protrusion protruding from the first main surface or a first depression recessed from the first main surface is provided on an edge of the first opening. The first head covers the first protrusion and is in contact with at least a part of the first protrusion, or covers the first depression and is in contact with at least a part of the first depression.

8 Claims, 9 Drawing Sheets

ANTENNA DEVICE

TECHNICAL FIELD

The present invention relates to an antenna device.

BACKGROUND

An antenna device transmitting and receiving a radiowave used for radio broadcasting, a GPS (Global Positioning System), an ETC (Electronic Toll Collection system) or the like is attached to a vehicle such as a passenger car. In Japanese Unexamined Patent Publication No. 2008-78895, an antenna device is disclosed which comprises an antenna element having a thru-hole through which a power supply pin passes, the antenna element being disposed at a distance from a circuit substrate due to an existence of the power supply pin.

SUMMARY

In the antenna device such as those described in Japanese Unexamined Patent Publication No. 2008-78895, it is desired to prevent misalignment of the antenna element in order to properly transmit and receive the radiowave. Particularly, in a vehicle-mounted antenna device, a position of the antenna element needs to be secured in order to resist vibration occurring when the vehicle is running.

An antenna device according to an aspect of the present invention comprises: an antenna element including a plate with a first opening, the plate including a first main surface and a second main surface opposed to each other; and a case in which the antenna element is stored, wherein the case comprises: a first projection projecting toward an inside of the case and passing through the first opening; a first head provided to a tip end of the first projection, the first head being in contact with the first main surface; and a first supporter in contact with the second main surface, wherein a first protrusion protruding from the first main surface or a first depression recessed from the first main surface is provided on an edge of the first opening on the plate, and wherein the first head covers the first protrusion and is in contact with at least a part of the first protrusion, or covers the first depression and is in tight contact with at least a part of the first depression.

According to the antenna device, on the plate of the antenna element, the first main surface is in contact with the first head and the second main surface is in contact with the first supporter. Accordingly, move of the antenna element in a direction perpendicular to a direction in which the first main surface and the second main surface extend is suppressed by interference by the first head and the first supporter. The first protrusion protruding from the first main surface or the first depression recessed from the first main surface is provided on the edge of the first opening on the plate. Then, if the first protrusion is provided, the first head covers the first protrusion and is in contact with at least a part of the first protrusion. Alternatively, if the first depression is provided, the first head covers the first depression and is in contact with at least a part of the first depression. Accordingly, the antenna element move in the direction in which the first main surface and the second main surface extend is suppressed by interference by the first head and the first protrusion or first depression. Therefore, since the antenna element move is three-dimensionally suppressed, the antenna element can be strongly fixed.

A second protrusion protruding from the first main surface may be provided on the edge of the first opening, the second protrusion may be provided on a side opposite to the first protrusion or the first depression with the first opening being interposed therebetween, and the first head may cover the second protrusion and may be in contact with at least a part of the second protrusion. In this case, the antenna element move in the direction in which the first main surface and the second main surface extend can be suppressed by interference by the first head and the second protrusion, besides the interference by the first head and the first protrusion or first depression. Particularly, the antenna element move in a direction in which the first protrusion or first depression faces the second protrusion can be well suppressed.

A second depression recessed from the first main surface may be provided on the edge of the first opening, the second depression may be provided on a side opposite to the first protrusion or the first depression with the first opening being interposed therebetween, and the first head may cover the second depression and may be in contact with at least a part of the second depression. In this case, the antenna element move in the direction in which the first main surface and the second main surface extend can be suppressed by interference by the first head and the second depression, besides the interference by the first head and the first protrusion or first depression. Particularly, the antenna element move in a direction in which the first protrusion or first depression faces the second depression can be well suppressed.

The first protrusion may be provided on the edge of the first opening, and the first protrusion may be a curved portion where a part of the edge of the first opening is curved toward the first main surface side. In this case, the first protrusion can be easily reduced in size to be able to suppress the influence on transmission and reception characteristics of the antenna element given by the first protrusion.

The first depression may be provided on the edge of the first opening, and the first depression may be a curved portion where a part of the edge of the first opening is curved toward the second main surface side. In this case, the first depression can be easily reduced in size to be able to suppress the influence on the transmission and reception characteristics of the antenna element given by the first depression.

The first supporter may be adjacent to the first projection and project toward the inside of the case. In this case, the plate of the antenna element can be separated from the bottom wall, the lateral wall and the like constituting the case.

The antenna device may comprise a circuit substrate stored in the case and electrically connected with the antenna element, wherein the circuit substrate with a second opening may include a third main surface and a fourth main surface opposed to each other, the case may comprises: a second projection projecting toward the inside of the case and passing through the second opening; a second head provided to a tip end of the second projection, the second head being in contact with the third main surface; and a second supporter being in contact with the fourth main surface, wherein a third protrusion protruding from the third main surface may be provided on an edge of the second opening on the circuit substrate, and wherein the second head may cover the third protrusion and be in contact with at least a part of the third protrusion. In this case, move of the circuit substrate stored in the case is three-dimensionally suppressed by the second head, the second supporter, and the third protrusion similarly to the antenna element. Therefore, the antenna element connected with the circuit substrate is unlikely to be influenced by the circuit substrate move so that the antenna element can be more strongly fixed.

A conductive film may be provided on the fourth main surface of the circuit substrate, and the plate of the antenna element and the circuit substrate may be separated from each other. In this case, an air-gap type antenna device can be formed by the antenna element and the circuit substrate. As described above, since both the antenna element move and the circuit substrate move are suppressed, it is possible to provide the antenna device capable of maintaining the good transmission and reception characteristics.

DETAILED DESCRIPTION

Figure 1:
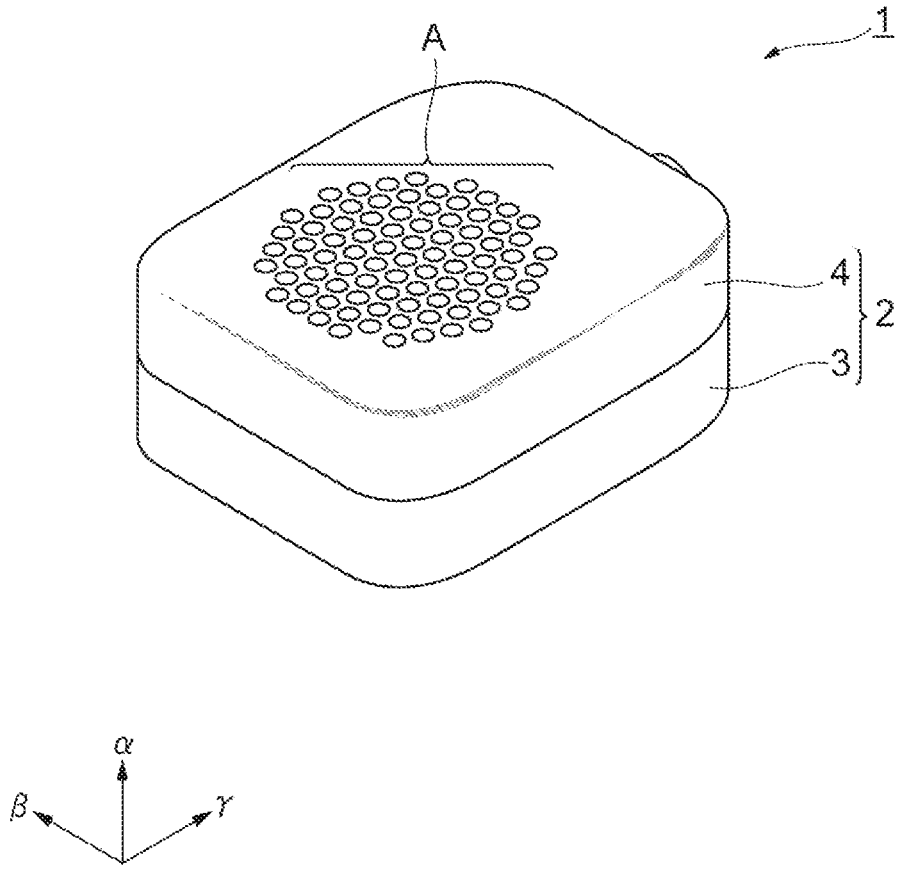
FIG. 1 is a perspective view showing an antenna device according to an embodiment.

Hereinafter, a description is given of a preferred embodiment according to the present invention referring to the drawings. In the following description, the same components or components having the same function are designated by the same reference sign, and a duplicated description is omitted.

An antenna device according to the embodiment, which is a vehicle-mounted patch antenna, has a function to transmit and receive a radio wave used for a GPS, an ETC or the like, for example. This antenna device is connected to an external device mounted on the vehicle via a wiring. Hereinafter, description of the wiring attached to the antenna device and an internal wiring of the antenna device is omitted.

Figure 2:
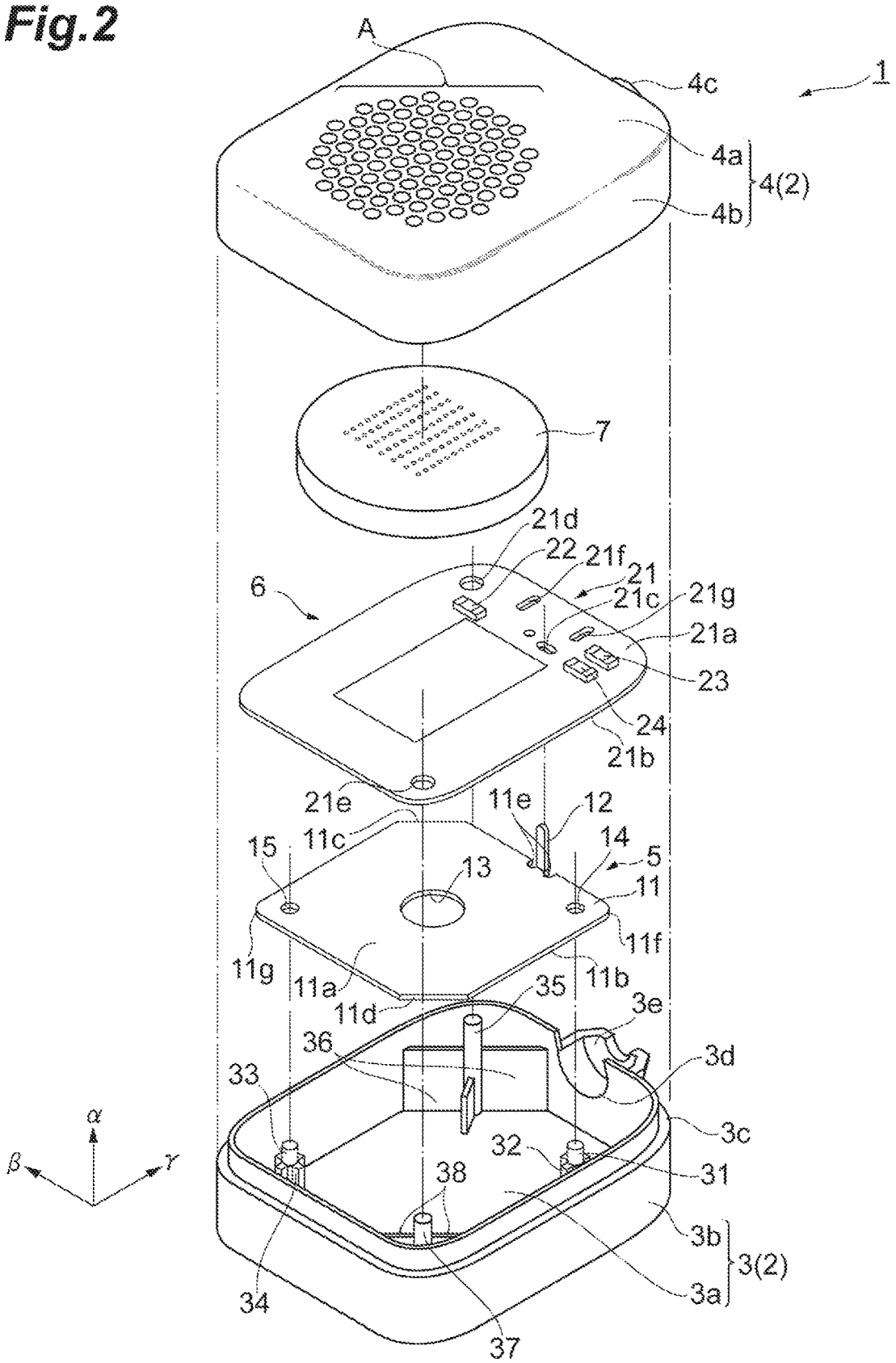
FIG. 2 is an exploded perspective view of the antenna device according to the embodiment.

FIG. 1 is a perspective view showing the antenna device according to the embodiment. FIG. 2 is an exploded perspective view of the antenna device according to the embodiment. FIG. 2 shows the exploded perspective view of the antenna device in a state where an antenna element and a circuit substrate which are described later are not fixed. An antenna device 1 shown in FIG. 1 and FIG. 2 includes a case 2, an antenna element 5, a circuit substrate 6, and a speaker 7. The antenna element 5, the circuit substrate 6, and the speaker 7 are stored in the case 2. In the case 2, the circuit substrate 6 is disposed between the antenna element 5 and the speaker 7. Hereinafter, a direction in which the antenna element 5, the circuit substrate 6, and the speaker 7 overlap each other is referred to as a direction α. A direction perpendicular to the direction α is referred to as a horizontal direction, one of directions which are along the horizontal direction is referred to as a direction β, and a direction perpendicular to the direction α and the direction β is referred to as a direction γ.

Hereinafter, an outline of the case 2 is firstly described. The case 2 is a housing made of resin having a substantially rectangular parallelepiped shape whose corners are rounded. Examples of the resin used for the case 2 include thermoplastic resin. Examples of thermoplastic resin include ABS resin. The case 2 has a main unit 3 and a lid 4 of the main unit 3. The main unit 3 of the case 2 is positioned on the antenna element 5 side in the direction α. The main unit 3 has a substantially rectangular shaped bottom wall 3*a*, and a lateral wall 3*b* projecting from an edge of the bottom wall 3*a* along the direction α. The bottom wall 3*a* and the lateral wall 3*b* are formed into one body using a mold or the like. Seen in the direction α, short sides of the bottom wall 3*a* extend along the direction β, and long sides of the bottom wall 3*a* extend along the direction γ. There are provided, on a rim side of the lateral wall 3*b*, a step seat portion 3*c* supporting the lid 4, a recessed part 3*d* provided on one short side of the bottom wall 3*a*, and an extending part 3*e* extending from an edge of the recessed part 3*d* to an outside of the case 2. The recessed part 3*d* is a portion recessed in a substantially semicircle shape seen in the direction γ, and the extending part 3*e* extends along the direction γ to the outside of the case 2. An external connecting wiring (not shown) coupling the circuit substrate 6 with the external device is arranged on the recessed part 3*d* and the extending part 3*e*. The rim side of the lateral wall 3*b* can be referred to a side of the lateral wall 3*b* in the direction α opposite to the bottom wall 3*a*.

The lid 4 of the case 2 has a substantially rectangular shaped top board 4*a*, and a lateral wall 4*b* projecting from an edge of the top board 4*a* along the direction α. The top board 4*a* and the lateral wall 4*b* are formed into one body using a mold or the like. Seen in the direction α, short sides of the top board 4*a* extend along the direction β, and long sides of the top board 4*a* extend along the direction γ. There are provided, at a center of the top board 4*a*, a plurality of openings A for externally output sound emitted from the speaker 7. On a rim side of the lateral wall 4*b*, provided is an extending part 4*c* arranged to join together the extending part 3*e* of the main unit 3. The extending part 4*c* has a shape similar to the extending part 3*e* and extends to the outside of the case along the direction γ. The rim side of the lateral wall 4*b* can be referred to a side of the lateral wall 4*b* in the direction α opposite to the top board 4*a*.

Figure 3A:
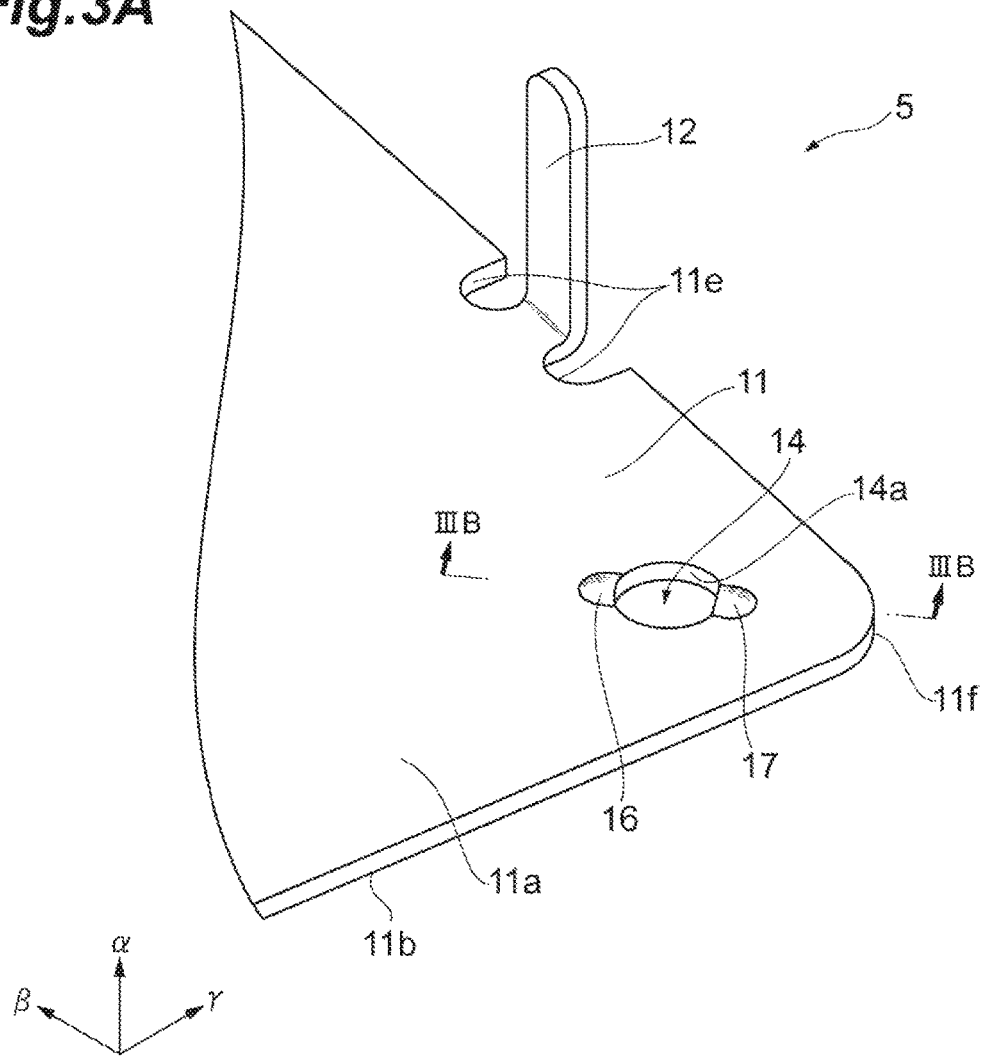
FIG. 3A is a main part enlarged view of the antenna element.
Figure 3B:
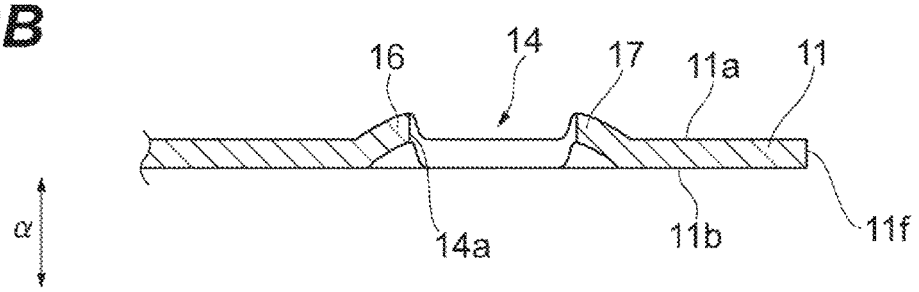
FIG. 3B is a sectional view taken along a line in FIG. 3A.

Next, the antenna element 5, the circuit substrate 6, and the speaker 7 stored in the case 2 are described in order. FIG. 3A is a main part enlarged view of the antenna element 5, and FIG. 3B is a sectional view taken along a line IIIB-IIIB in FIG. 3A. The antenna element 5 shown in FIG. 2 and FIGS. 3A and 3B, which is a member transmitting and receiving the radiowave, has a plate 11, a power feeding point 12 projecting from an edge of the plate 11 along the direction α, and openings 13 to 15 provided on the plate 11.

The plate 11, which is a substantially square shaped metal plate whose corners are rounded, is a unit transmitting and receiving the radiowave in the antenna element 5. In the plate 11, a surface on the circuit substrate 6 side is referred to as a main surface 11*a* (first main surface), and an opposite surface to the main surface 11*a* is referred to as a main surface 11*b* (second main surface). One pair of sides constituting the main surfaces 11*a* and 11*b* extends along the direction β, the other pair of sides constituting the main surfaces 11*a* and 11*b* extends along the direction γ. A length of one side of the main surfaces 11*a* and 11*b* is, for example, corresponds to about half a wavelength λ the antenna device 1 transmits and receives, and a thickness of the plate 11 is, for example, about 0.3 mm. Two corners opposing each other of the corners of the plate 11 are cut off to provide cut-off portions 11*c* and 11*d* to the plate 11.

The power feeding point 12, which is a part electrically connecting the plate 11 with the circuit substrate 6, is formed by bending a part projecting from the edge of the plate 11 toward the circuit substrate 6 side. For this reason, the power feeding point 12 and the plate 11 are formed of the identical metal plate. At the edge of the plate 11, recesses 11*e* are provided on both sides of a location where the power feeding point 12 is provided.

Each of the openings 13 to 15 is a thru-hole extending along the direction α, and has a substantially circular shape seen in the direction α. The opening 13 is provided at a center of the plate 11 in order to increase transmission and reception performance of the plate 11. A diameter of the opening 13 is made larger than diameters of the openings 14 and 15. The openings 14 and 15 having substantially the same shape as each other are provided adjacent to two corners 11*f* and 11*g* not cut off of the corners of the plate 11. The opening 14 (first opening) is provided adjacent to the corner 11*f* near the power feeding point 12, and the opening 15 is provided adjacent to the corner 11*g*. In the embodiment, the adjacency to the corner of the plate 11 is an area on the plate 11 at a distance of two times to ten times the thickness of the plate 11 from the corner. The openings 14 and 15 may be provided to other area than the above adjacency.

On an edge 14*a* of the opening 14 on the plate 11, provided is a protrusion 16 (first protrusion) protruding from the main surface 11*a*. The protrusion 16 is a curved portion where a part of the edge 14*a* is curved toward the main surface 11*a* side so that the protrusion protrudes from the main surface 11*a* to the circuit substrate 6 side along the direction α. The protrusion 16 protrudes in such a way as to form a part of a sphere, for example. There is provided, on the edge 14*a* of the opening 14, a protrusion 17 (second protrusion) protruding from the main surface 11*a* similar to the protrusion 16. The protrusion 17 is a curved portion having a shape similar to the protrusion 16, provided on a side opposite to the protrusion 16 with the opening 14 being interposed therebetween. In the embodiment, the edge 14*a* of the opening 14 on the plate 11 includes not only an inner surface of the opening 14 but also the plate 11 adjacent to the opening 14. The curved portion includes not only a portion bent in such a way as to have a curved surface but also a portion bent in such a way as to have an angle. In other words, in the embodiment, the curve also includes merely bending or fold (e.g., mountain fold, valley fold, and the like).

Figure 5:
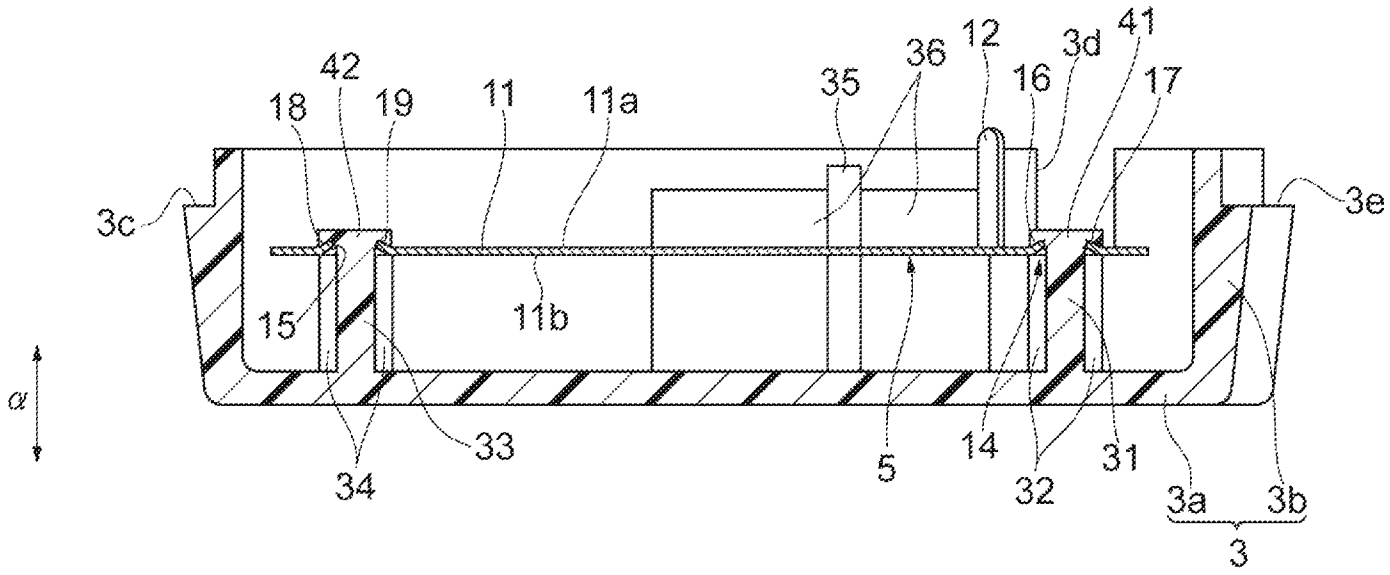
FIG. 5 is a sectional view taken along line V-V in FIG. 4.

There are provided, on an edge of the opening 15 on the plate 11, protrusions 18 and 19 having the shapes similar to the protrusions 16 and 17 (see FIG. 5). The openings 13 to 15 and the protrusions 16 to 19 are provided to overlap one of diagonal lines of the main surface 11*a*.

The circuit substrate 6 has a functional circuit for the speaker 7. The circuit substrate 6 has a substrate 21 as a main body, and capacitors 22 to 24 or the like constituting the functional circuit. The substrate 21 is a plate-shaped member having a substantially rectangular shape whose corners are rounded. The substrate 21 has a main surface 21*a* (third main surface) on the speaker 7 side, a main surface 21*b* (fourth main surface) opposite to the main surface 21*a*, an opening 21*c* through which the power feeding point 12 passes, openings 21*d* and 21*e* through which projections 35 and 37 described later in the case 2 respectively pass, and connection parts 21*f* and 21*g* with which the external connecting wiring (not shown) is connected. In the substrate 21, short sides of the main surfaces 21*a* and 21*b* extend along the direction β, and long sides of the main surfaces 21*a* and 21*b* extend along the direction γ. The main surfaces 21*a* and 21*b* are slightly larger than the main surfaces 11*a* and 11*b* of the plate of the antenna element 5. A thickness of the substrate 21 is about 0.8 mm, for example.

In the substrate 21, conductive patterns are formed on at least a part of the main surface 21*a*, on the main surface 21*b*, and on a surface constituting the opening 21*c*. The conductive pattern formed on the main surface 21*a* (not shown) is wiring of the functional circuit or the like. The conductive pattern formed on the main surface 21*b*, which is a conductive film 25 covering the main surface 21 (see FIG. 8B), is a ground pattern for the antenna element 5. The conductive pattern formed on the surface constituting the opening 21*c* (not shown) is a pattern connecting with the power feeding point 12. For this reason, the conductive pattern formed on the main surface 21*b* and the conductive pattern formed on the surface constituting the opening 21*c* are insulated from each other.

The circuit substrate 6 and the plate 11 are separated from each other in the direction α in the case 2. Specifically, the main surface 21*b* of the substrate 21 in the circuit substrate 6 is separated from the main surface 11*a* of the plate 11 by a predetermined distance in the direction α. Here, since a space between the circuit substrate 6 and the plate 11 is not filled with an insulating material or the like, the space serves as a dielectric in the antenna device 1. Therefore, the antenna device 1 in embodiment is a so-called air-gap type antenna device.

The speaker 7, which is a device emitting sound corresponding to the output from the circuit substrate 6 or the external device, is electrically connected with the circuit substrate 6. The speaker 7 is supported by the lid 4.

Next, a description is given in detail of a configuration which the main unit 3 of the case 2 has using FIG. 2. The main unit 3 has the projections 31 and 33 and supporters 32 and 34 relating to the antenna element 5, and the projections 35 and 37 and supporters 36 and 38 relating to circuit substrate 6.

The projection 31 (first projection) has a substantially columnar shape, and is a member passing through the opening 14 on the plate 11. The projection 31 projects from the bottom wall 3*a* toward an inside of the case 2 along the direction α, and is positioned in an area surrounded by the lateral wall 3*b*. In order that the projection 31 is ensured to be inserted into the opening 14, a diameter of the projection 31 is made smaller than the diameter of the opening 14. For this reason, a gap is generated between the projection 31 and the edge 14*a* of the opening 14 seen in the direction α.

The supporter 32 (first supporter) is a member brought into contact with the main surface 11*b* of the plate 11 to support the antenna element 5. The supporter 32 projects from the bottom wall 3*a* toward the inside of the case 2 along the direction α, and is positioned in the area surrounded by the lateral wall 3*b*. In the embodiment, the supporter 32 has four pillarlike parts adjacent to the projection 31, and the pillarlike parts are arranged in a substantially cross shape seen in direction α. Accordingly, a strength of the projection 31 is reinforced by the supporter 32.

A projecting length of the projection 31 in the direction α is larger than a projecting length of the supporter 32. Specifically, a difference in the projecting length between the projection 31 and the supporter 32 is larger than at least the thickness of the plate 11. Therefore, when the plate 11 is supported by the supporter 32, a tip end of the projection 31 is positioned closer to the circuit substrate 6 than the main surface 11*a* of the plate 11.

The projection 33 has a substantially columnar shape, and is a member passing through the opening 15 on the plate 11. The supporter 34 is a member brought into contact with the main surface 11*b* of the plate 11 to support the antenna element 5. The projection 33 has a shape and function substantially the same as the projection 31, and the supporter 34 has a shape and function substantially the same as the supporter 32. Therefore, the plate 11 is supported by the supporters 32 and 34 in the direction α.

The projection 35 (second projection) has a substantially columnar shape, and is a member passing through the opening 21*d* (second opening) of the substrate 21. The supporter 36 (second supporter) is a member brought into contact with the main surface 21*b* of the substrate 21 to support the circuit substrate 6. The projection 35 and the supporter 36 are positioned in the area surrounded by the lateral wall 3*b*, and are positioned closer to the lateral wall 3*b* than the cut-off portion 11*c*. The projection 35 and the supporter 36 project from the bottom wall 3*a* toward the inside of the case 2 along the direction α. A projecting length of the projection 35 in the direction α is larger than a projecting length of the supporter 36. Specifically, a difference in the projecting length between the projection 35 and the supporter 36 is larger than at least the thickness of the circuit substrate 6. Therefore, when the substrate 21 is supported by the supporter 36, a tip end of the projection 35 is positioned closer to the speaker 7 than the main surface 21*a* of the circuit substrate 6. In the embodiment, the supporter 36 has two plates adjacent to the projection 35, and the plates couple the projection 35 with the lateral wall 3*b*. Accordingly, a strength of the projection 35 is reinforced by the supporter 36.

The projection 37 has a substantially columnar shape, and is a member passing through the opening 21*e* of the substrate 21. The supporter 38 is a member brought into contact with the main surface 21*b* of the substrate 21 to support the circuit substrate 6. The projection 37 and the supporter 38 are positioned in the area surrounded by the lateral wall 3*b*, and are positioned closer to the lateral wall 3*b* than the cut-off portion 11*d*. The projection 37 has a shape substantially the same as and a function the same as the projection 35, and the supporter 38 has a shape substantially the same as and a function the same as the supporter 36. Therefore, the circuit substrate 6 is supported by the supporters 36 and 38 in the direction α.

The projecting lengths of the supporters 36 and 38 are made larger than the projecting lengths of the projections 31 and 33 and supporters 32 and 34. In addition, a difference in the projecting length between the supporters 36 and 38 and the supporters 2 and 34 corresponds to a distance between the main surface 11*a* of plate 11 and the main surface 21*b* of the substrate 21 in the direction α in addition to the thickness of the plate 11.

Figure 4:
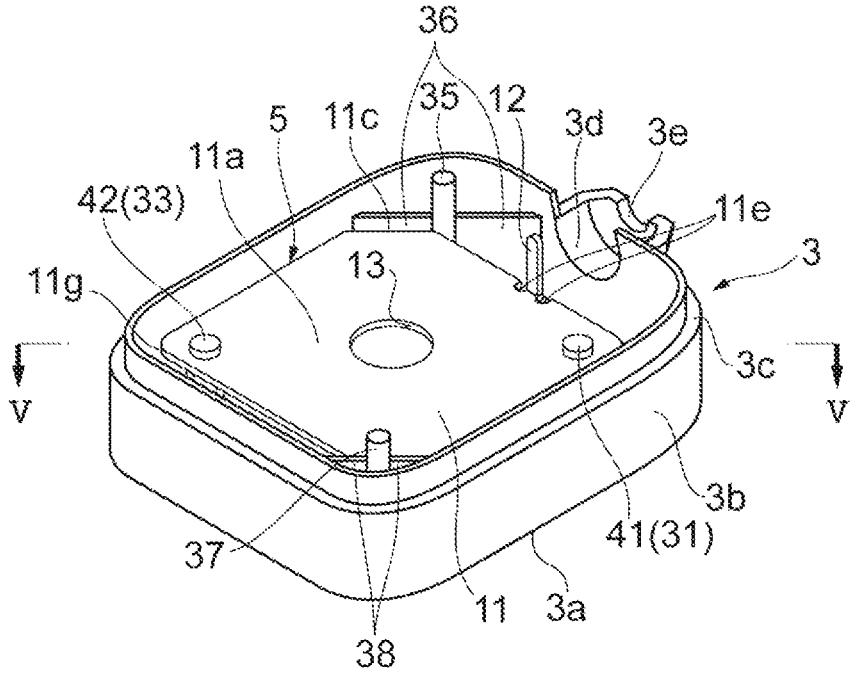
FIG. 4 is a perspective view showing a state where the antenna element is fixed to a case.
Figure 4:
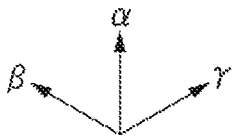

Next, a description is given of a state where the antenna element 5 is fixed to the main unit 3 of the case 2 using FIG. 4 and FIG. 5. FIG. 4 is a perspective view showing a state where the antenna element 5 is fixed to the case 2. FIG. 5 is a sectional view taken along line V-V in FIG. 4. As shown in FIG. 4 and FIG. 5, in the state where the antenna element 5 is fixed to the main unit 3 of the case 2, the antenna element 5 is supported by the supporters 32 and 34 in the direction α. Here, a head 41 (first head) is provided to the tip end of the projection 31 positioned on the main surface 11*a* of the plate 11. The head 41 has a substantially circular shape seen in the direction α, and is provided to cover the protrusions 16 and 17 and be in contact with at least a part of the protrusions 16 and 17. Specifically, a surface of the head 41 on the bottom wall 3*a* side is in tight contact with at least the main surface 11*a* constituting the protrusions 16 and 17. For this reason, a diameter of the head 41 is made lager than the diameter of the opening 14. The tip end of the projection 33 positioned on the main surface 11*a* also has a substantially circular shape seen in the direction α, and is provided with a head 42 which covers the protrusions 18 and 19 and is in contact with at least a part of the protrusions 18 and 19. Accordingly, the antenna element 5 is sandwiched by the supporters 32 and 34 and the heads 41 and 42 in the direction α.

Figure 6A:
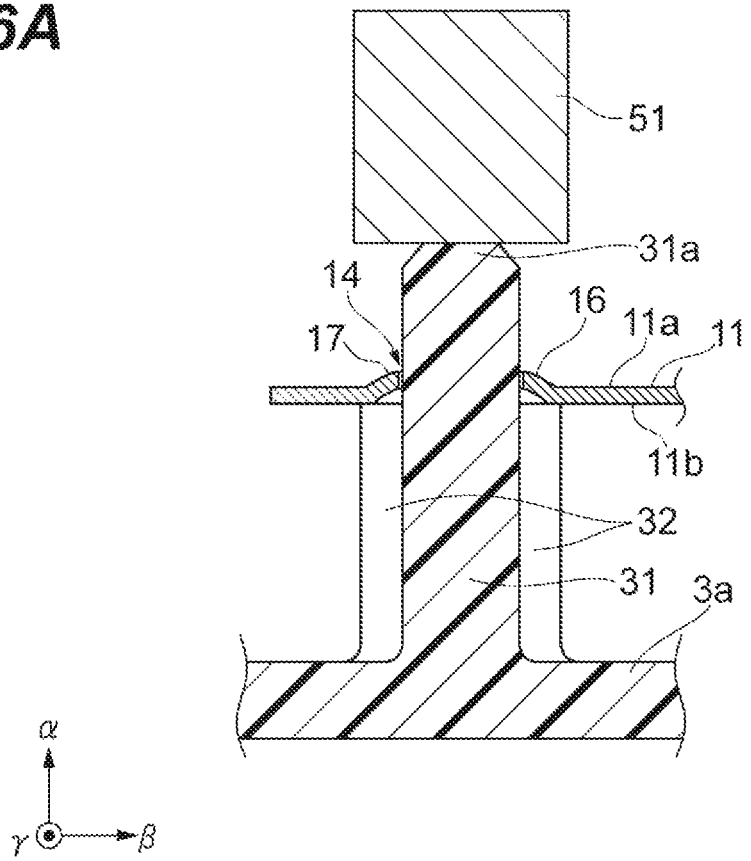
FIGS. 6A and 6B each are a diagram illustrating an example of a method of forming a head.
Figure 6B:
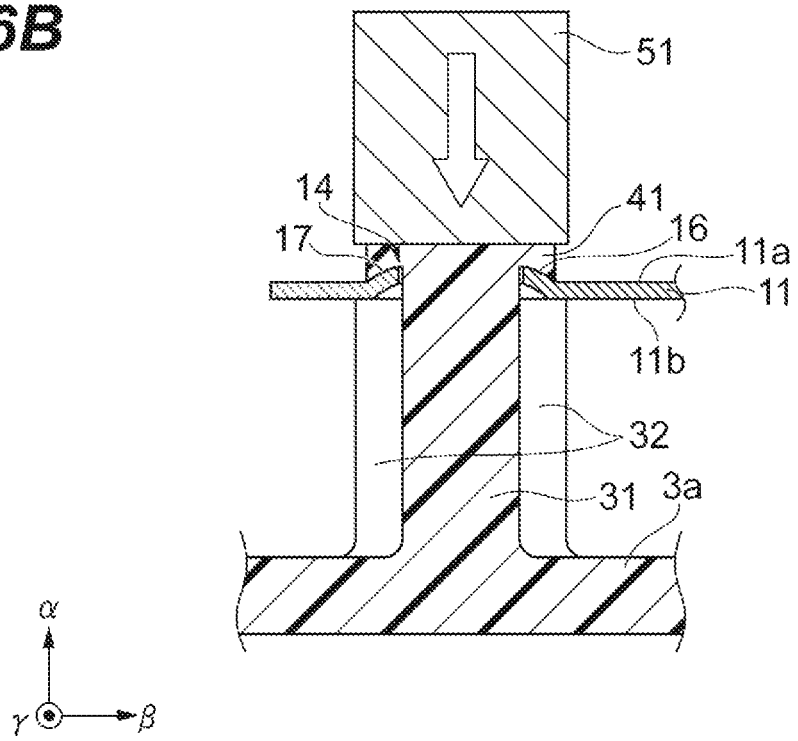

Here, a description is given of an example of a method of forming the head 41 using FIGS. 6A and 6B. As shown in FIG. 6A, first, the projection 31 is made to pass through the opening 14, and the antenna element 5 is stored in the main unit 3 so that the main surface 11*b* of the plate 11 is brought into contact with the supporter 32. At this time, the projection 33 is made to pass through the opening 15 to support the plate 11 by the supporters 32 and 34, decrease in an inclination of the plate 11 is conducted. Next, the tip end of the projection 31 is brought into contact with a heated pressing member 51. Accordingly, a tip end portion 31*a* of the projection 31 is heated and melted. At this time, since the plate 11 is supported by the supporters 32 and 34, the projection 31 can be thermally melted without bringing the antenna element 5 into contact with the bottom wall 3*a*.

Next, as shown in FIG. 6B, the pressing member 51 is made to move toward the projection 31 along the direction α to crush (thermally caulk) the heated and softened tip end portion 31*a*. This allows the crushed tip end portion 31*a* to cover the protrusions 16 and 17. Then, the pressing member 51 is separated from the projection 31 to cool the tip end portion 31*a*. This forms the head 41 which covers the protrusions 16 and 17 and is in contact with at least the main surface 11*a* constituting the protrusions 16 and 17. The head 42 is formed by the method similar to the head 41. As described above, the heads 41 and 42 are formed after the antenna element 5 is stored in the case 2 so that the antenna element 5 is sandwiched and fixed by the supporters 32 and 34 and the heads 41 and 42.

Figure 7A:
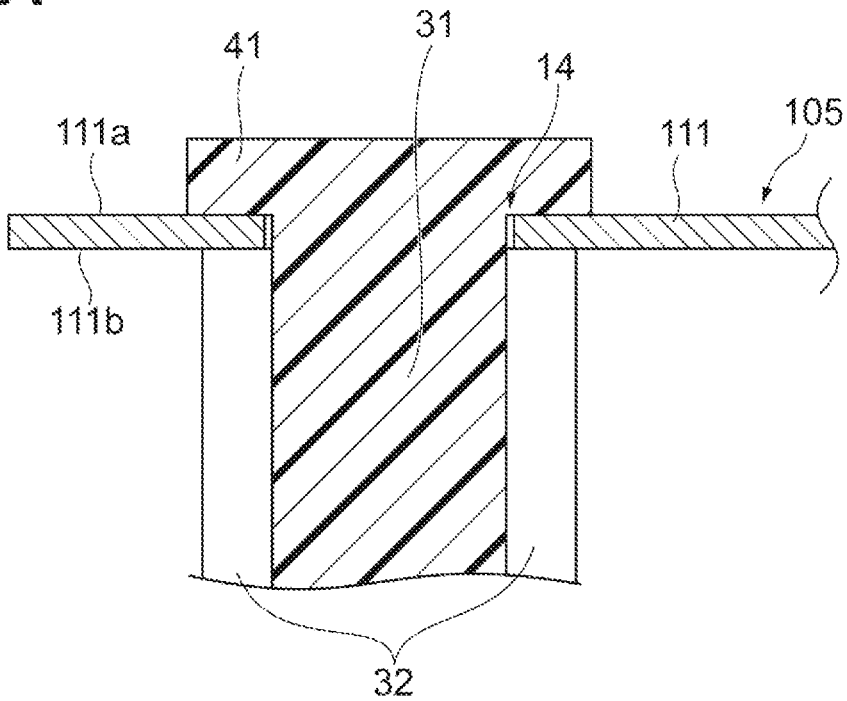
FIG. 7A is a main part enlarged sectional view of an antenna device according to a comparative example.

A description is given of an action and effect of the antenna device 1 according to the embodiment described above while comparing with a comparative example shown below. FIG. 7A is a main part enlarged sectional view of an antenna device according to a comparative example, and FIG. 7B is a main part enlarged sectional view of the antenna device 1 according to the embodiment.

As shown in FIG. 7A, in an antenna element 105 of the antenna device according to the comparative example, a protrusion is not provided on the edge of the opening 14 provided on a plate 111. For this reason, the head 41 of the projection 31 covers a main surface 111*a* where a concave and a convex are not provided and is in contact with the main surface 111*a*. Here, if the head 41 is formed by the above method, the antenna element 105 is unlikely to be pressed by the head 41. In this case, a binding force by the head 41 and the supporter 32 in the direction α tends to not be sufficiently applied to the antenna element 105. For this reason, if a gap is generated between the opening 14 and the projection 31 in the horizontal direction, the antenna element 105 easily moves in the horizontal direction perpendicular to the direction α depending on the vibration occurring when the vehicle is running. This possibly influences transmission and reception characteristics of the antenna device. Particularly, in the case of the air-gap type antenna device, the transmission and reception characteristics may be notably influenced.

Figure 7B:
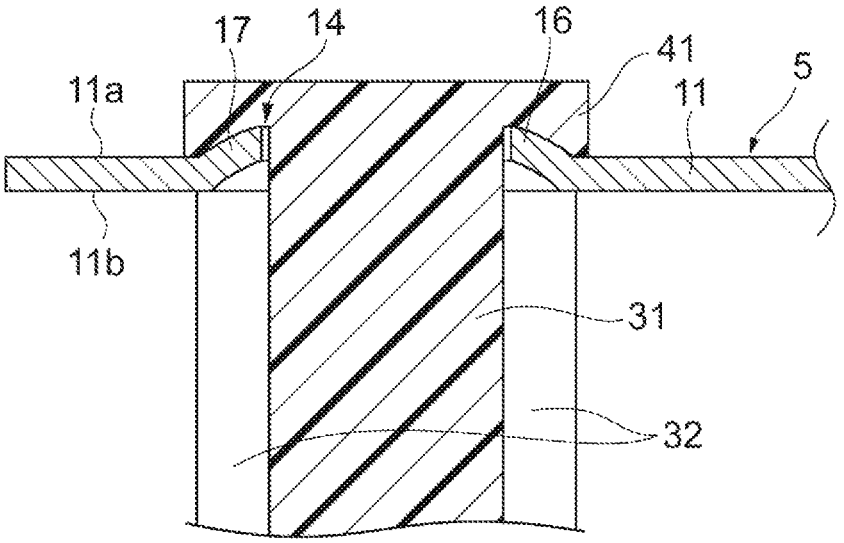
FIG. 7B is a main part enlarged sectional view of the antenna device according to the embodiment.

In contrast, in the antenna device 1 according to the embodiment, the main surface 11*a* is in contact with the head 41 and the main surface 11*b* is in contact with the supporter 32 in the plate 11 of the antenna element 5 as shown in FIG. 7B. As shown in FIG. 5, also the main surface 11*a* is in contact with the head 42 and the main surface 11*b* is in contact with the supporter 34. Accordingly, the antenna element 5 move in the direction α is suppressed by interference by the heads 41 and 42 and the supporters 32 and 34. On the edge of the opening 14 on the plate 11, the protrusion 16 protruding from the main surface 11*a* is provided. The head 41 covers the protrusion 16 and is in contact with at least a part of the protrusion 16. Accordingly, the antenna element 5 move in the horizontal direction is suppressed by interference by the head 41 and the protrusion 16. Specifically, the head 41 three-dimensionally covers the main surface 11*a* constituting the protrusion 16 and is in tight contact with the protrusion 16 so that the antenna element 5 move in the horizontal direction is suppressed. Therefore, since the antenna element 5 move is three-dimensionally suppressed, the antenna element 5 can be strongly fixed according to the antenna device 1 in the embodiment.

Additionally, on the edge of the opening 14, the protrusion 17 protruding from the main surface 11*a* is provided. The protrusion 17 is provided on the side opposite to the protrusion 16 with opening 14 being interposed therebetween, and the head 41 covers the protrusion 17 and is in contact with at least a part of the protrusion 17. Therefore, the antenna element 5 move in the horizontal direction can be further suppressed by interference by the head 41 and the protrusion 17, besides the interference by the head 41 and the protrusion 16. Particularly, the antenna element 5 move in a direction in which the protrusions 16 and 17 face each other can be well suppressed. Further, since the protrusions 16 and 17 are provided to face each other with the opening 14 being interposed therebetween, the tip end portion 31*a* of the projection 31 easily spreads evenly. This allows the protrusions 16 and 17 to be well covered by the head 41.

Further, the plate 11 is provided with the opening 15 in addition to the opening 14. On the edge of the opening 15, provided are the protrusions 18 and 19 which are covered by the head 42 and in contact with the head 42. Therefore, the antenna element 5 move in the horizontal direction can be further suppressed by interference by the head 42 and the protrusions 18 and 19, besides the interference by the head 41 and the protrusions 16 and 17.

The protrusion 16 is a curved portion where a part of the edge of the opening 14 is curved toward the main surface 11*a* side. For this reason, the protrusion 16 can be easily reduced in size to be able to suppress the influence on the transmission and reception characteristics of the antenna element 5 given by the protrusion 16.

The supporter 32 is adjacent to the projection 31 and projects toward the inside of the case 2. Therefore, the plate 11 of the antenna element 5 can be separated from the bottom wall 3*a*, the lateral wall 3*b* and the like constituting the case 2. In addition, when the head 41 is crushed by the pressing member 51, the supporter 32 supports the antenna element 5 so that occurrence of deformation in the plate 11 or the like can be prevented.

Figure 8A:
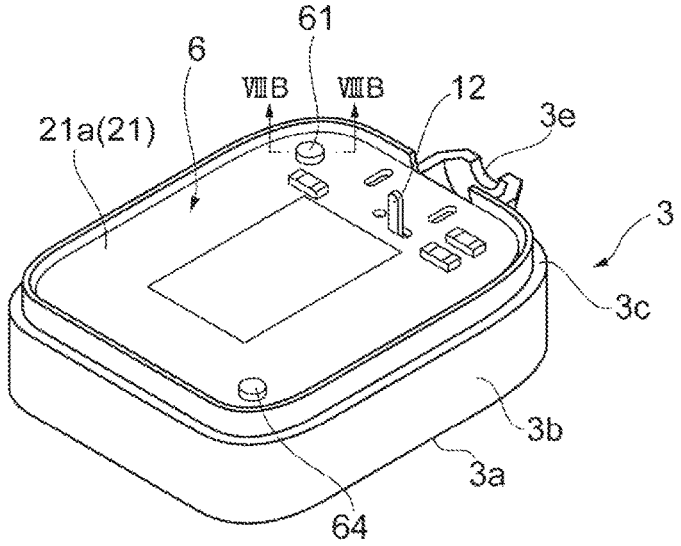
FIG. 8A is a perspective view showing a state where a circuit substrate is fixed to the case.
Figure 8B:
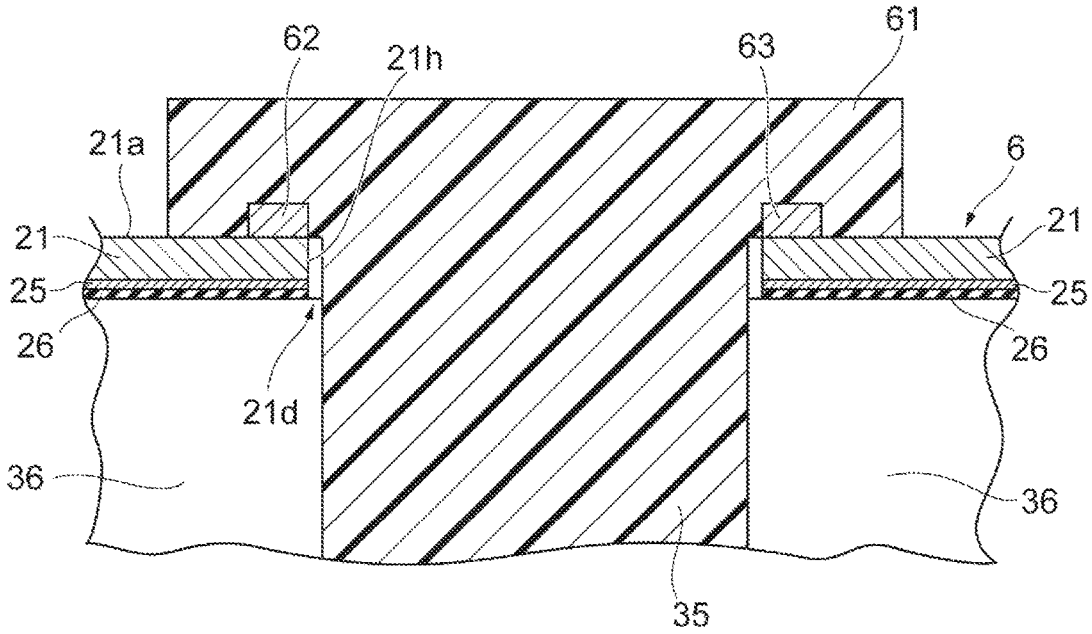
FIG. 8B is a sectional view taken along a line VIIIB-VIIIB in FIG. 8A.

FIG. 8A is a perspective view showing a state where the circuit substrate 6 is fixed to the case 2, and FIG. 8B is a sectional view taken along a line VIIIB-VIIIB in FIG. 8A. As shown in FIGS. 8A and 8B, in the state where the circuit substrate 6 is fixed to the case 2, the circuit substrate 6 is supported by the supporter 36 (and the supporter 38) similarly to the antenna element 5. Here, a head 61 (second head) is provided to the tip end of the projection 35 positioned on the main surface 21*a* of the substrate 21. The head 61 has a substantially circular shape seen in the direction α and is in contact with the main surface 21*a* of the substrate 21. Additionally, at least a part of head 61 overlaps the supporter 36 in the direction α. Therefore, the circuit substrate 6 is supported by the head 61 and the supporter 36 in the direction α. The head 61 is formed by the method similar to the heads 41 and 42.

On an edge 21*h* of the opening 21*d* on the substrate 21, provided is a protrusion 62 (third protrusion) protruding toward the head 61. The protrusion 62 is a protrusion formed on the main surface 21*a*, and overlaps the head 61 in the direction α. The protrusion 62 is formed by soldering or the like, for example. There is provided, on the edge 21*h* of the opening 21*d*, a protrusion 63 having the shape similar to the protrusion 62. The protrusion 63 is provided on a side opposite to protrusion 62 via the opening 21*d*. Here, the head 61 covers the protrusions 62 and 63, and is in contact with at least a part of the protrusions 62 and 63. Accordingly, the circuit substrate 6 move is three-dimensionally suppressed similarly to the antenna element 5. Specifically, well suppressed are not only the circuit substrate 6 move along the direction α by the interference by the supporter 36 and the head 61, but also the circuit substrate 6 move along the horizontal direction by the interference by the head 61 and the protrusions 62 and 63. Therefore, the antenna element 5 connected via the power feeding point 12 with the circuit substrate 6 is unlikely to be influenced by the circuit substrate 6 move so that the antenna element 5 can be more strongly fixed.

A head 64 similar to the head 61 is provided to the tip end of the projection 37 positioned on the main surface 21*a* of the substrate 21, and the protrusions similar to the protrusions 62 and 63 are provided on an edge of the opening 21*e* on the circuit substrate 6. Therefore, the circuit substrate 6 is sandwiched also by the head 64 and the supporter 38 in the direction α, and the circuit substrate 6 move is further suppressed by the head 64 and the protrusion.

Additionally, the conductive film 25 is provided on the main surface 21*b* of the substrate 21 in the circuit substrate 6 so that the plate 11 of the antenna element 5 and the circuit substrate 6 are separated from each other. This forms the air-gap type antenna device 1 by the antenna element 5 and the circuit substrate 6. As described above, since both the antenna element 5 move and the circuit substrate 6 move are suppressed, it is possible to provide the antenna device 1 capable of maintaining the good transmission and reception characteristics. The conductive film 25 may be covered by an insulating film 26 In this case, short circuit between the conductive film 25 and other elements or the like can be suppressed. Here, the conductive pattern on a part of the main surface 21*a* may also be covered by an insulator.

Figure 9A:
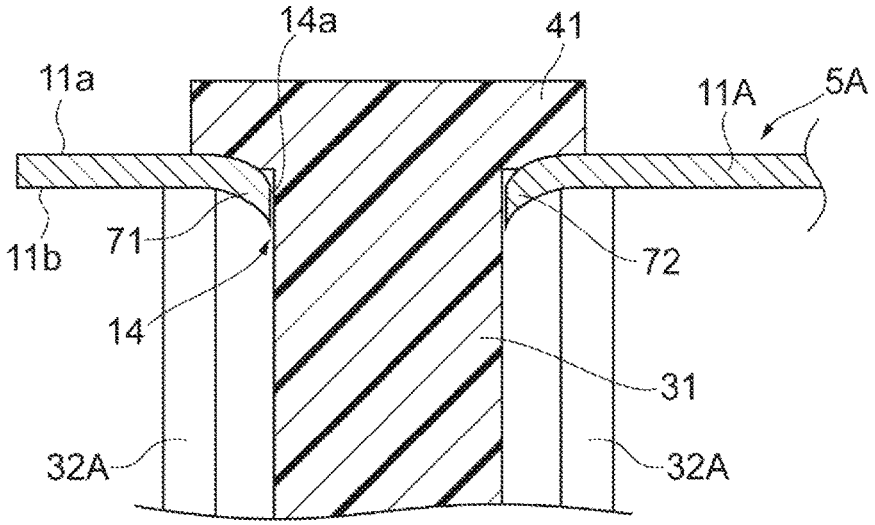
FIG. 9A is a main part enlarged sectional view of an antenna device according to a first modification example of the embodiment.

FIG. 9A is a main part enlarged sectional view of an antenna device according to a first modification example of the embodiment. As shown in FIG. 9A, on the edge 14*a* of the opening 14 on a plate 11A, provided is a depression 71

(first depression) recessed from the main surface 11*a*. The depression 71 is a curved portion where a part of the edge 14*a* of the opening 14 is curved toward the main surface 11*b* side in such a way as to protrude from the main surface 11*b* to the bottom wall 3*a* side along the direction α. The depression 71 is recessed in such a way as to form a part of a sphere, for example. In other words, the depression 71, as compared to the protrusion 16 shown in FIG. 3B, is formed by curving the plate 11 toward a side opposite to the main surface 11*a* in the direction α. There is provided, on the edge 14*a* of the opening 14, a depression 72 (second depression) having the shape similar to the depression 71. The depression 72 is provided on a side opposite to the depression 71 with the opening 14 being interposed therebetween. In the first modification example, since the misalignment of the antenna element 5 in the case 2 is prevented, the depressions 71 and 72 and the supporter 32A may not be in contact with each other. In the first modification example, the projection 31 and the supporter 32A are separated from each other.

The head 41 covers the depressions 71 and 72, and is in contact with at least part of the depressions 71 and 72. Specifically, a part of the head 41 on the main surface 11*a* side gets into the depressions 71 and 72, and is in contact with the main surface 11*a* constituting surfaces of the depressions 71 and 72. In the first modification example, the antenna element 5A move in the horizontal direction is also suppressed by interference by the head 41 and the depressions 71 and 72. Therefore, in the first modification example, an operational advantage similar to the embodiment can be obtained.

Figure 9B:
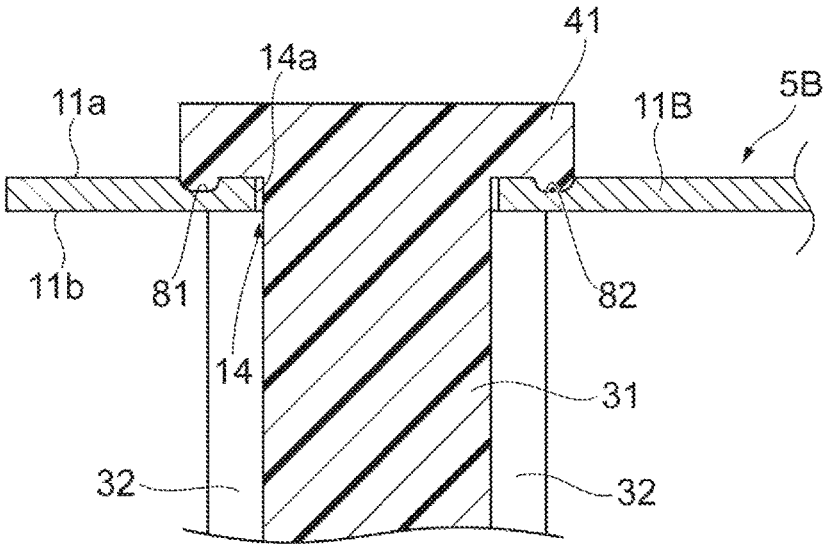
FIG. 9B is a main part enlarged sectional view of an antenna device according to a second modification example of the embodiment.

FIG. 9B is a main part enlarged sectional view of an antenna device according to a second modification example of the embodiment. As shown in FIG. 9B, adjacent to the edge 14*a* of the opening 14 on a plate 11B, provided are depressions 81 and 82 recessed from the main surface 11*a*. The depressions 81 and 82, which are grooves recessed in the direction α with reference to the main surface 11*a*, are provided to face each other with the opening 14 being interposed therebetween. The head 41 covers the depressions 81 and 82, and is in contact with at least part of the depressions 81 and 82. Specifically, an edge of the head 41 gets into the depressions 81 and 82. In the second modification example like this also, the antenna element 5B move in the horizontal direction is suppressed by interference by the head 41 and the depressions 81 and 82. Therefore, in the second modification example, an operational advantage similar to the embodiment and first modification can be obtained. The adjacency to the edge 14*a* of the opening 14 on the plate 11B corresponds to a position on the plate 11B that separates from the edge 14*a* and overlaps the head 41.

The antenna device according to an aspect of the present invention is not limited to the above described embodiment and the above modification example, and other various modifications may be made. For example, contents of the embodiment and the modification example may be adequately combined. For example, the embodiment and the first modification example or the second modification example may be combined such that both the protrusion and the depression are provided to the antenna element. In this case, the protrusion and a plurality of forms of the depressions may be provided to the antenna element. Only one of the protrusion and the depression for interfering with the head may be provided to the antenna element.

In the embodiment and the modification example, the shapes of the case, antenna element, circuit substrate and the like are adequately modified depending on application or the like where the antenna device is required. For example, when the antenna device is a device for receiving the radiowave for telephone, the plate of the antenna element may not be flat plate-shaped.

In the embodiment and the modification example, the shape and number of the supporters 32 and 34 are not limited. In addition, in the embodiment and the modification example, the supporters 32 and 34 may not be formed. In this case, the antenna element 5 is arranged on the bottom wall 3*a* of the case 2, for example, so that the bottom wall 3*a* serves as the supporter for the antenna element 5. Further, in the embodiment and the second modification example also, the projection 31 and the supporter 32 may be separated from each other similarly to the first modification example.

In the embodiment and the modification example, the openings 13 to 15 and the protrusions 16 to 19 are provided to overlap one of the diagonal lines of the main surface 11*a*, but are not limited thereto. For example, at least one of the openings 13 to 15 and the protrusions 16 to 19 may not overlap the diagonal line. Even in this case, an action and effect similar to the embodiment and the modification example are exerted.

In the embodiment and the modification example, there may be provided, on the edge 21*h* of the opening 21*d* on the substrate 21, not the protrusions 62 and 63, but depressions recessed from the main surface 21*a*. In this case, the edge of the head 61 gets into the depressions so that the circuit substrate 6 move is suppressed by interference by the head 61 and the depressions. There may be also provided, on the edge of the opening 21*e* on the circuit substrate 6, not the protrusions but depressions recessed from the main surface 21*a*. This depression is formed by removing a part of the substrate 21, for example.

In the embodiment and the modification example, the protrusions 62 and 63 may not be provided on the circuit substrate 6. Similarly, the protrusions overlapping the head 64 may not be provided on the circuit substrate 6.

This application is based on Japanese Patent Application serial no. 2016-148556 filed with Japan Patent Office on Jul. 28, 2016, the entire contents of which are hereby incorporated by reference.

What is claimed is:

1. An antenna device comprising:

an antenna element including a plate with a first opening, the plate including a first main surface and a second main surface opposed to each other; and a case in which the antenna element is stored, wherein the case comprises:

a first projection projecting toward an inside of the case and passing through the first opening;

a first head provided to a tip end of the first projection, the first head being in contact with the first main surface; and a first supporter in contact with the second main surface, wherein a first protrusion protruding from the first main surface or a first depression recessed from the first main surface is provided on an edge of the first opening of the plate, and wherein the first head covers the first protrusion and is in contact with at least a part of the first protrusion, or covers the first depression and is in contact with at least a part of the first depression.

2. The antenna device according to claim 1, wherein a second protrusion protruding from the first main surface is provided on the edge of the first opening, wherein the second protrusion is provided on a side opposite to the first protrusion or the first depression with the first opening being interposed therebetween, and wherein the first head covers the second protrusion and is in contact with at least a part of the second protrusion.

3. The antenna device according to claim 1, wherein a second depression recessed from the first main surface is provided on the edge of the first opening, wherein the second depression is provided on a side opposite to the first protrusion or the first depression with the first opening being interposed therebetween, and wherein the first head covers the second depression and is in contact with at least a part of the second depression.

4. The antenna device according to claim 1, wherein the first protrusion is provided on the edge of the first opening, and wherein the first protrusion is a curved portion where a part of the edge of the first opening is curved toward the first main surface side.

5. The antenna device according to claim 1, wherein the first depression is provided on the edge of the first opening, and wherein the first depression is a curved portion where a part of the edge of the first opening is curved toward the second main surface side.

6. The antenna device according to claim 1, wherein the first supporter is adjacent to the first projection and projects toward the inside of the case.

7. The antenna device according to claim 1, further comprising a circuit substrate stored in the case and electrically connected with the antenna element, wherein the circuit substrate with a second opening includes a third and main surface and a fourth main surfaces opposed to each other, wherein the case comprises:

a second projection projecting toward the inside of the case and passing through the second opening;

a second head provided to a tip end of the second projection and being in contact with the third main surface; and a second supporter being in contact with the fourth main surface, wherein a third protrusion protruding from the third main surface is provided on an edge of the second opening of the circuit substrate, and wherein the second head covers the third protrusion and is in contact with at least a part of the third protrusion.

8. The antenna device according to claim 7, wherein a conductive film is provided on the fourth main surface of the circuit substrate, and wherein the plate of the antenna element and the circuit substrate are separated from each other.

* * * * *